US007619351B2

(12) United States Patent
Watanabe et al.

(10) Patent No.: US 7,619,351 B2
(45) Date of Patent: Nov. 17, 2009

(54) STRUCTURES FOR SUPPORTING DISCHARGE LAMPS AND ILLUMINATING SYSTEM

(75) Inventors: Keiichiro Watanabe, Kasugai (JP); Takashi Ota, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 491 days.

(21) Appl. No.: 11/391,945

(22) Filed: Mar. 29, 2006

(65) Prior Publication Data

US 2006/0220513 A1 Oct. 5, 2006

(30) Foreign Application Priority Data

Mar. 31, 2005 (JP) ..... 2005-103610

(51) Int. Cl.
*H01J 1/88* (2006.01)

(52) U.S. Cl. ..... 313/267; 313/113

(58) Field of Classification Search ..... 313/623, 313/113, 238, 267; 362/341, 285, 287, 508, 362/523, 418, 416, 430
See application file for complete search history.

(56) References Cited

U.S. PATENT DOCUMENTS

| | | | | |
|---|---|---|---|---|
| 3,341,731 | A * | 9/1967 | Wilson | 313/113 |
| 4,456,947 | A | 6/1984 | Alexander | |
| 4,771,207 | A * | 9/1988 | Page | 313/25 |
| 5,128,589 | A * | 7/1992 | Dakin | 313/634 |
| 2006/0019044 | A1 | 1/2006 | Watanabe | |
| 2006/0022596 | A1 | 2/2006 | Watanabe et al. | |
| 2008/0054775 | A1 * | 3/2008 | Kling et al. | 313/113 |

FOREIGN PATENT DOCUMENTS

| | | | |
|---|---|---|---|
| CA | 2193286 | | 6/1997 |
| EP | 0 780 884 | | 6/1997 |
| EP | 0 856 867 | | 8/1998 |
| EP | 1 500 866 | | 1/2005 |
| GB | 2 062 958 | | 5/1981 |
| JP | 05-008684 | A1 | 1/1993 |
| JP | 06-064201 | A1 | 9/1994 |
| JP | 2001-076677 | A1 | 3/2001 |

* cited by examiner

*Primary Examiner*—Peter Macchiarolo
(74) *Attorney, Agent, or Firm*—Burr & Brown

(57) ABSTRACT

The inventive structure has a reflector substrate comprising a brittle material, a first power supply member electrically connected to a first electrode and a second power supply member electrically connected to a second electrode. A first through hole and a second through hole are provided in the reflector substrate. The first power supply member is inserted into and fixed to a first through hole and the second power supply member is inserted into and fixed to the second through hole. A discharge lamp is supported by the reflector substrate through the power supply members, while the discharge lamp is distant from the reflector substrate.

11 Claims, 5 Drawing Sheets

STRUCTURES FOR SUPPORTING DISCHARGE LAMPS AND ILLUMINATING SYSTEM

This application claims the benefit of Japanese Patent Application P2005-103610 filed on Mar. 31, 2005, the entirety of which is incorporated by reference.

TECHNICAL FIELD

The present invention relates to a structure for supporting a discharge lamp and an illuminating system.

BACKGROUND OF THE INVENTION

A high pressure discharge lamp with a discharge vessel of quartz has been widely used as a head light for an automobile due to its high brightness and light emission efficiency. The discharge vessel has a light emitting portion and contains a light emitting gas inside of the vessel. The discharge vessel of such discharge lamp is made of quartz and thus transparent, so that the light emitting portion may function as a point light source.

Japanese patent publication 5-8684A (8684A/1993) disclosed a head lamp for an automobile having a combination of a metal halide lamp and a high pressure sodium lamp as light sources for the head lamp.

The assignee filed a Japanese patent publication 2001-76677A, and disclosed a high pressure discharge lamp usable as a pseudo point light source for an automobile head lamp. According to the description in the publication, when a light emitter is contained within a light emitting vessel made of quartz and powered, the inner light emitter in the transparent quartz vessel may be shown from the outside of the vessel. The light emitter thereby functions as a point light source. On the contrary, a high pressure discharge lamp using a vessel of a translucent polycrystalline alumina is semitransparent, so that the whole of the vessel functions as an integral light emitter when observed from the outside of the vessel. It is thereby necessary to sufficiently miniaturize the light emitting vessel itself so that the vessel may function as a pseudo point light source.

For example in a head lamp for an automobile, a light emitting vessel is set on a predetermined position. Light emitted from the vessel is then reflected by a reflector to project the reflected light forwardly. The relationship of three dimensional positions of the point light source and reflector, as well as the surface shape of the reflector, are accurately determined, so as to avoid a reduction of condensing efficiency at a focal point.

As described above, the relationship of three dimensional positions of the point light source in the discharge lamp (or the pseudo point light source) and the reflector should be accurately determined. The method of fixing the discharge lamp with respect to the reflector substrate thus becomes problematic.

For example, Japanese utility model application 6-64201A discloses a method of fixing as shown in FIG. 1. That is, a through hole 7 for fixing an electrode and a setting hole 11*a* for fixing a discharge lamp are provided in a reflector substrate 11 composed of a ceramic.

When a luminous vessel 5 is fixed at a specific position with respect to the reflector substrate 11, one end of the luminous vessel 5 is inserted into a setting hole 11*a*. At this stage, the end part 5*a* and a power supply member 2A pass through the setting hole 11*a* and protrudes to the side of the convex of the reflector substrate 11. A metal jig 22 for power supply is provided to the tip end of the end part 5*a*, and the metal jig 22 protrudes to the outside of the reflector substrate 11. Further, a power supply member 20 is mechanically fixed and electrically connected to a power supply member 6 intersecting the same. The tip end of the power supply member 6 is inserted into a through hole 7 of the reflector substrate 11. The luminous vessel 5 is then positioned.

SUMMARY OF THE INVENTION

However, such supporting structure has the following problems. That is, one end 5*a* of the luminous vessel 5 is inserted into the setting hole 11*a* of the reflector substrate 11, so that the arc A (point source) in the luminous vessel 5 is accurately positioned three dimensionally with respect to the inner face of the reflector substrate. A joining material 14 is then filled into the setting hole 11*a* to solidify the bonding material 14. Heat resistant cement (trade name: SUMICERAM) is widely used as the bonding material. The bonding material 14 is exposed to the outside of the reflector substrate 11, and a fixing jig 21 is inserted into and fixed to the bonding material 14.

It is, however, difficult to fill the bonding agent 14 in the setting hole 11*a* while the point light source "A" in the luminous vessel 5 is accurately and three-dimensionally positioned. Further, the bonding agent 14 tends to shrink and deform due to distribution of density therein during the hardening of the bonding agent 14 in the setting hole 11*a*, even if the discharge ark "A" would have been accurately and three-dimensionally positioned with respect to the inner face of the reflector substrate 11 at the stage of filling the bonding agent 14. The position of one end 5*a* of the luminous vessel 5 is shifted due to the shrinkage and deformation of the bonding agent 14, so that the position of the discharge arc "A" is shifted with respect to the inner face of the reflector substrate to result in a reduction of condense density at the position of condensation of projected beam. The resulting product would be out of a specification to lower the production yield.

An object of the present invention is to provide a structure of preventing the shift of the position where projected beam is condensed, when a discharge lamp is fixed with respect to a reflector substrate made of a brittle material in a structure for supporting the discharge lamp with the reflector substrate made of a brittle material.

The present invention provides a structure for supporting a discharge lamp with a reflector substrate comprising a brittle material, the discharge lamp comprises a first electrode and a second electrode for discharge. The structure comprises a reflector substrate; a first power supply member electrically connected to the first electrode; and a second power supply member electrically connected to the second electrode. A first through hole and a second through hole are formed in the reflector substrate, the first power supply member is inserted into and fixed in the first through hole, and the second power supply member is inserted into and fixed in the second through hole. The discharge lamp is supported with the reflector substrate through said first and second power supply members so that the discharge lamp is floated over floated over the reflector substrate.

The present invention further provides an illumination system comprising the above structure and a discharge lamp supported with the structure. The illumination system of the present invention includes a finished part before a reflector film is formed on the reflector substrate and an illumination system after the reflector film is formed on the reflector substrate to furnish a projector illumination system.

According to the present invention, the first power supply member and second power supply member each connected with the electrode of the discharge lamp are inserted into the through holes of the reflector substrate, respectively. The first and second power supply members are thus fixed to the reflector substrate. It is thereby possible to actively align the discharge lamp at a predetermined position by fixing the first and second power supply members at the corresponding positions. At this stage, different from the case that the discharge lamp is fixed in the setting hole 11 of the reflector substrate by means of the bonding material 14, the diameter of the through hole 1*a* for inserting the first power supply member is small and the amount of the bonding material required for the fixing is low. The positioning error of the first power supply member during the cure of the bonding agent can be ignored. It is thus possible to prevent the shift of the condensed position of the projected beam and to improve the production yield, so that the present invention is very useful in the industry.

PREFERRED EMBODIMENTS OF THE INVENTION

The present invention will be described further in detail, referring to the attached drawings.

Figure 2:
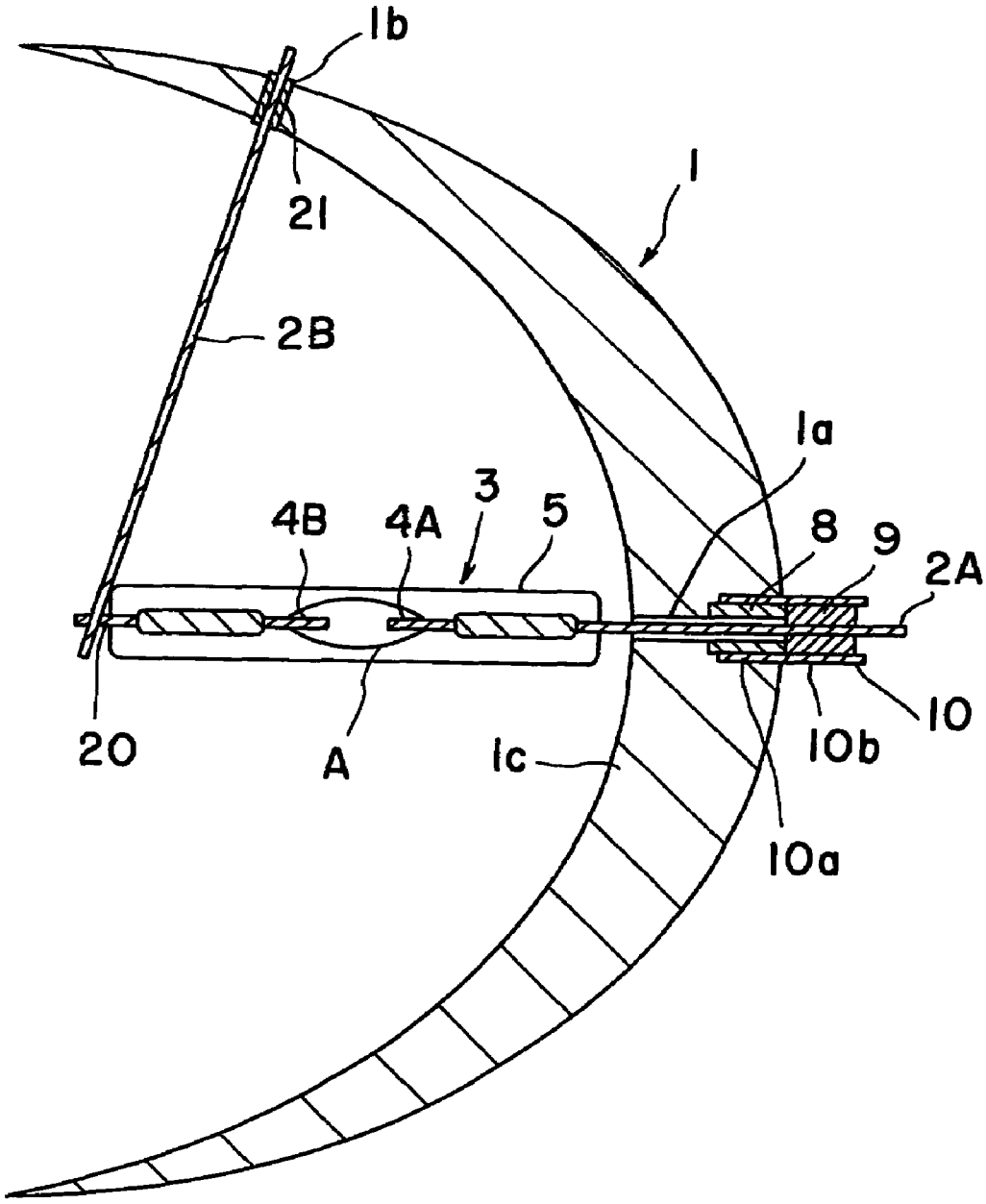
FIG. 2 is a cross sectional view schematically showing a structure of supporting a discharge lamp 3 according to one embodiment of the present invention.

FIG. 2 is a cross sectional view schematically showing a supporting structure according to the present invention. Through holes 1*a* and 1*b* for fixing power supply members, respectively, are formed at predetermined positions of a reflector substrate 1 made of a brittle material. Power supply members 2A and 2B are protruded in the direction of axis of the luminous vessel 5 from the luminous vessel 5 of a discharge lamp 3.

A first power supply member 2A is inserted into and fixed in the through hole 1*a*, when the luminous vessel 5 is fixed at a predetermined position with respect to the reflector substrate 1. Further, a power supply member 20 is fitted to a second power supply member 2B so that the member 20 is mechanically and electrically connected to the member 2B. When the second power supply member 2B is moved, the discharge vessel 5 is moved toward the same direction by the same distance at the same time. The power supply member 2B may be inserted into the through hole 1*b* and then fixed with a bonding material 21. Discharge arc "A" can be positioned at a predetermined position by positioning the first power supply member 2A and the second power supply member 2B while the luminous vessel 5 is floated over the inner wall surface of the reflector substrate 1*c*.

Figure 1:
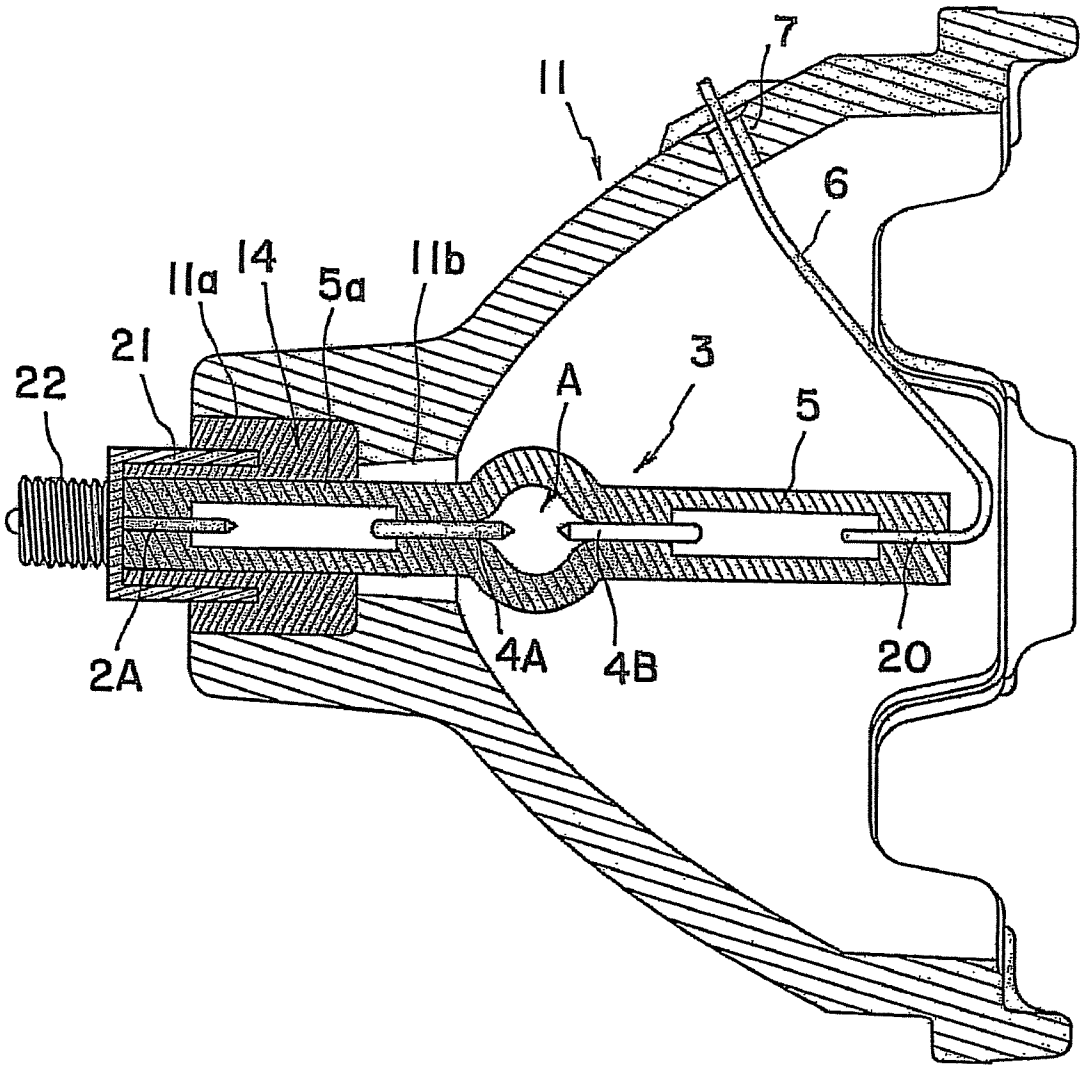
Fig. 1 PRIOR ART
FIG. 1 is a cross sectional view schematically showing a structure of inserting and bonding an end part 5*a* to a reflector substrate 11.

In this stage, according to the structure shown in FIG. 1, it is necessary to insert the end part 5*a* of the luminous vessel 5 of a discharge lamp into the setting hole of the reflector substrate and then fix it with a bonding agent. The position tends to be shifted from its target position, and the positional shift may be considerable especially during the cure of the bonding agent. According to the inventive structure for example shown in FIG. 2, however, the first power supply member 2A and second power supply member 2B are inserted into the through holes 1*a* and 1*b*, respectively. The power supply members 2A and 2B are then moved to actively align the discharge vessel 5 so that the density of condensed light at a predetermined position by means of the reflector can be improved. Different from the case that the luminous vessel 5 is inserted into the setting hole, the luminous vessel can be positioned by inserting the power supply members into the respective through holes. The diameter of the through hole and the amount of the bonding agent can be minimized, so that the positioning error of the luminous vessel 5 due to the shrinkage and deformation of the bonding agent during the cure can be prevented.

Figure 3:
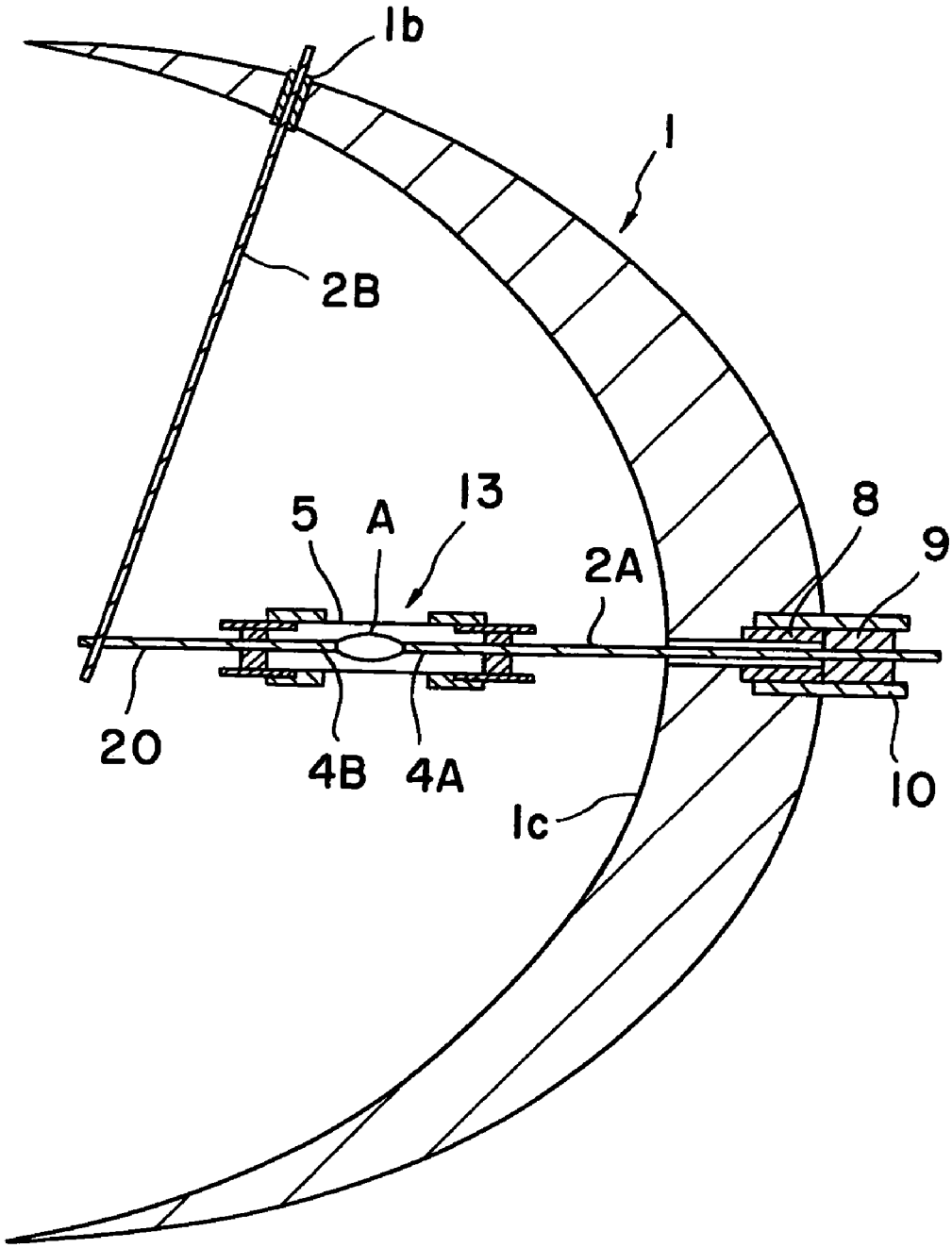
FIG. 3 is a cross sectional view schematically showing a structure of supporting a discharge lamp 3 according to another embodiment of the present invention.

FIG. 2 mainly shows a high pressure discharge lamp of so-called quartz luminous vessel type. On the other hand, FIG. 3 shows a supporting structure similar to that shown in FIG. 2, and the same components will be depicted using the same numerals and the descriptions may be referred to. According to the example shown in FIG. 3, however, a discharge vessel 13 used is of so-called sapphire luminous vessel type. The present invention is not limited to such type of discharge lamp and may be applicable to various types of discharge lamps.

The brittle material forming the reflector substrate is not particularly limited, and includes glass (a glass ceramics), ceramics, single crystal and cermet having resistances against heat and thermal shock.

Such glass includes quartz glass, aluminum silicate glass, borosilicate glass, silica-alumina-lithium series crystallized glass, silica-alumina-zinc-series crystallized glass and silica-alumina-barium series crystallized glass etc. The ceramics includes, for example, ceramics having corrosion resistance against a halogen series corrosive gas, and may preferably be alumina, yttria, yttrium-aluminum garnet, aluminum nitride, silicon nitride or silicon carbide. Single crystals of any of the materials selected from the above may be used. The cermet may be composite materials of a ceramics such as alumina, yttria, yttrium-aluminum garnet and aluminum nitride and a metal such as molybdenum, tungsten, hafnium and rhenium. The single crystal includes those being optically transparent in visual ray band, such as diamond (single crystal of carbon) or sapphire ($Al_2O_3$ single crystal).

When the luminous vessel is transparent, the discharge arc "A" in the luminous vessel functions as a point light source. Light radiated from the point light source "A" is thus reflected by a reflector film on the reflector substrate 1. The point light source "A", thus luminous vessel 5, should be positioned at a high precision and three dimensionally with respect to the inner wall surface of the reflector for improving the condensing efficiency after the reflection. Further, when the luminous vessel is translucent (for example, having an overall light transmittance of 85 percent or more and a linear transmittance of 30 percent or more), the whole of the luminous vessel functions as a pseudo point light source. For improving the condensing efficiency after the reflection, the pseudo point light source and thus the luminous vessel 5 should be positioned at a high precision and three dimensionally with respect to the inner wall surface of the reflector substrate.

First and second electrodes for discharge are provided in the discharge vessel. Materials and shapes of the electrodes are not particularly limited. Such material may preferably be a pure metal selected from the group consisting of tungsten, molybdenum, niobium, rhenium and tantalum, or the alloy of two or more metals selected from the group consisting of tungsten, molybdenum, niobium, rhenium and tantalum. Tungsten, molybdenum or the alloy of tungsten and molybdenum is particularly preferred. Further, it is preferred a composite material of the pure metal or alloy described above and a ceramic material.

Materials and shapes of the first power supply member 2A eletrically connected to the first electrode 4A and the power supply members 2B and 20 electrically connected to the second electrode 4B are not particularly limited. Such material may preferably be a pure metal selected from the group consisting of tungsten, molybdenum, rhenium, niobium, and tantalum, or the alloy of two or more metals selected from the group consisting of tungsten, molybdenum, niobium, rhenium and tantalum. Tungsten, molybdenum or the alloy of tungsten and molybdenum is particularly preferred. Further, it is preferred a composite material of the pure metal or alloy described above and a ceramic material. Alternatively, an oxidation resistant iron-based alloy (stainless steel, nichrome, iron chrome etc.) and nickel are preferred.

Further, each electrode and the corresponding power supply member connected to each electrode may be made of the same material, so that the bonding of different materials can be avoided to considerably reduce the production cost.

The kind of the discharge lamp is not particularly limited, and includes a metal halide lamp, high pressure sodium lamp, and super high pressure mercury lamp.

The applications of the discharge lamp according to the present invention are not particularly limited, and include various kinds of illumination systems using a point light source or pseudo point light source such as a head lamp for an automobile, OHP (over head projector) and liquid crystal projector.

According to the present invention, the discharge lamp is supported while it is floated over the reflector substrate. It is sufficient that the discharge vessel is distant from the reflecting face of the reflector substrate, and the distance itself is to be decided upon the design of the reflector and thus not particularly limited.

The first power supply member is inserted into and fixed in the first through hole and the second power supply member is inserted into and fixed in the second through hole provided in the reflector substrate. The specific method of supporting is not particularly limited and includes the followings.

(1) A bonding agent is filled in a space between the power supply member inserted into the through hole and the wall surface facing the through hole and solidified to fix the power supply member.

(2) A supporting member is fixed to the brittle material forming the luminous vessel, and the power supply member is fixed to the supporting member. According to the method (2), it is not necessary to directly bond the brittle material and power supply member so that the power supply member can be positioned more accurately and easily.

Figure 4:
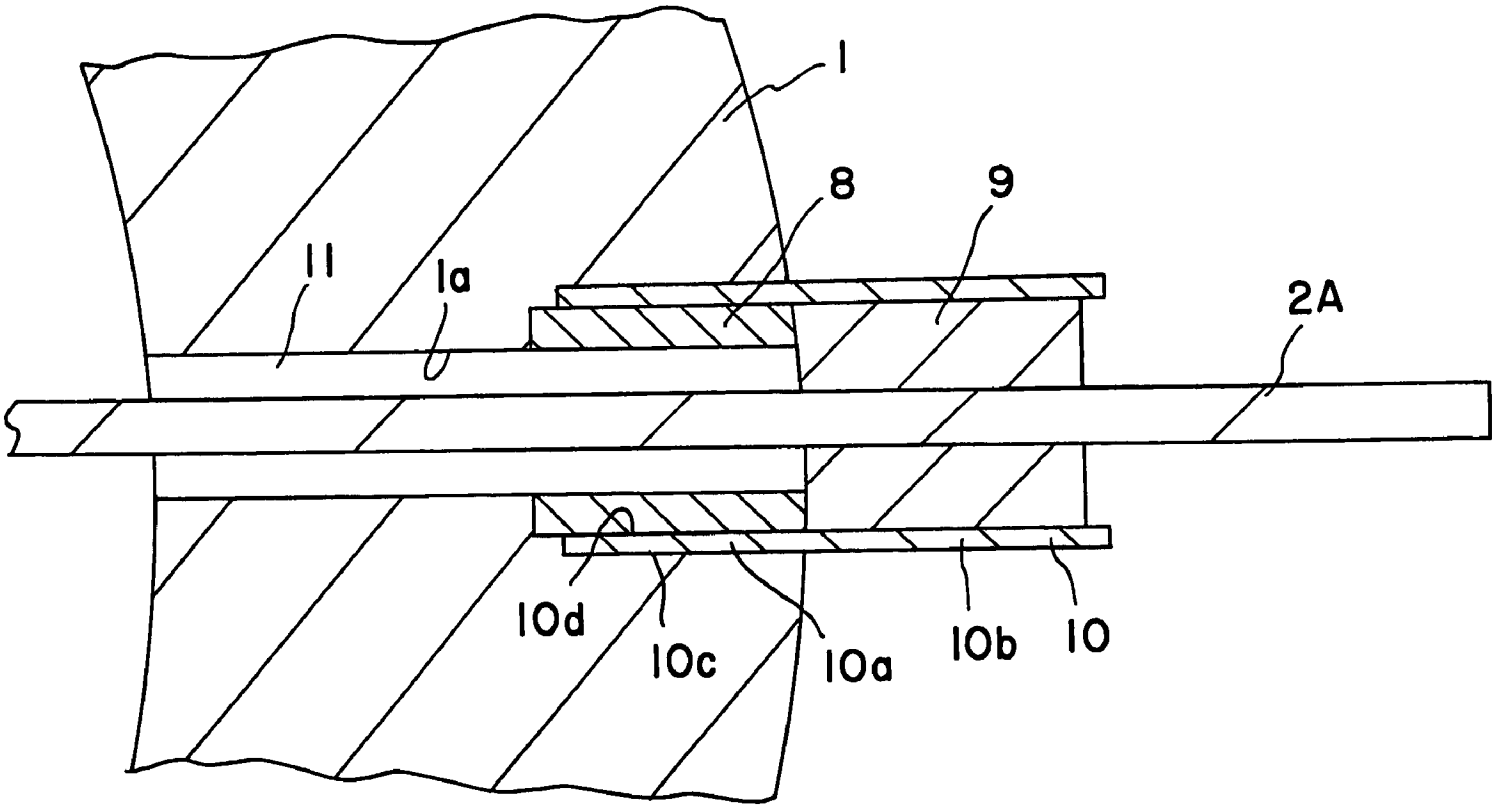
FIG. 4 is a cross sectional view showing an enlarged view of a fitting part of a first power supply member 2A to a reflector substrate 1.

FIG. 4 is a cross sectional view schematically showing a bonding structure according to the embodiment of (2). A first power supply member 2A is inserted into the through hole 1*a* of the reflector substrate 1 and protruded outside of the reflector substrate 1. On the other hand, a clamped part 10*a* of a plate shaped metal piece 10 is fitted to the reflector substrate 1. A first surface 10*c* of the clamped part 10*a* is pressed and clamped with the brittle material forming the reflector substrate 1. A second surface 10*d* of the clamped part 10*a* is pressed and clamped with an inner supporting body 8. A non-clamped part 10*b* of the plate shaped metal piece 10 is protruded to the outside of the reflector substrate 1. A fixing member 9 is provided between the outer face of the first power supply member 2A and the inner side face of the plate shaped metal piece 10, so that the first power supply member 2A is fixed to the non-clamped part 10*b* of the plate shaped metal piece 10. The fixing member 9 and power supply member 2A, and the fixing member 9 and plate shaped metal piece 10 are bonded with each other, respectively.

Further, bonding materials may be provided between the inner supporting body 8 and plate shaped metal piece 10 and between the plate shaped metal piece 10 and reflector substrate 1, respectively.

According to an embodiment (2), the method of fitting of the supporting member to reflector substrate is not particularly limited, and may be a chemical process using a bonding agent described below or a mechanical process. The following methods are particularly preferred. That is, the supporting member is formed of a plate shaped metal piece and the clamped part of the supporting member is clamped with the brittle material. A stress generated along the interface where the clamped part and brittle material contact each other is relaxed by the deformation of the plate shaped metal piece. In this case, although the clamped part of the plate shaped metal piece and brittle material may be press bonded with each other, a bonding material may be preferably provided between the clamped part and brittle material. The bonding materials may be those described later.

In this case, both sides of the clamped part may be contacted with the brittle material forming the luminous vessel. Alternatively, the first surface of the plate shaped metal piece may be clamped with the reflector substrate and the second surface may be clamped with an inner supporting body made of a specific material (for example a brittle material).

According to this embodiment, the plate-shaped metal piece may preferably be pressed and clamped at both sides in the direction of thickness with brittle materials having thermal expansion coefficients being substantially equivalent or same with each other. It is thus possible to avoid the generation of stress between the opposing brittle material portions. Stress generated in the metal member provides substantially equivalent distribution with respect to the central plane passing through the center of the metal member in the direction of thickness. Further, the metal member has a thickness considerably smaller than that of the brittle material, so that the stress generated in the metal member is relaxed by the plastic deformation of the metal. It is thus possible to avoid the possibility of critical damages such as bending and crack formation of the metal member or considerable deformation, even after the press clamping and under the use condition of temperature change.

According to the present embodiment, the stress generated along the contact interface between the clamped portion and the brittle material is relaxed due to the deformation of the clamped part of the plate-shaped metal piece.

The stress along the contact interface of the clamped portion and brittle material is generated, for example, due to the following mechanism. The thermal expansion coefficient of the metal material is represented by "$\alpha 1$",the Young's modulus of the metal is represented by "E1", the thermal expansion coefficient of the brittle material is represented by "$\alpha 2$" and the Young's modulus of the brittle material is represented by "E2". It is now provided that the metal material is embedded in the brittle material, and the brittle material is then sintered at a sintering temperature "T1" and cooled to room temperature so that the metal material is pressed and clamped with the brittle material. In this case, it is provided that both materials would not be deformed and would not slide along the interface, the stress "σ1" generated in the metal would be represented by the following formula.

$$\sigma 1 \propto E1 \times (T1 - \text{room temperature}) \times (\alpha 1 - \alpha 2) \quad (1)$$

The stress "σ2" generated in the brittle material fixing the metal piece at both sides is similarly represented by the formula.

$$\sigma 2 \propto E2 \times (T1 - \text{room temperature}) \times (\alpha 2 - \alpha 1) \quad (2)$$

The combination of molybdenum and alumina is taken for example, the thermal expansion coefficient and Young's modulus of molybdenum are about 5 ppm/K and about 330 GPa, respectively. The thermal expansion coefficient and Young's modulus of alumina are about 8 ppm/K and about 360 GPa, respectively. For example, when alumina is sintered at 1500° C. and then cooled to room temperature, a compressive stress of about 1500 MPa would be generated in molybdenum, provided that there is no plastic deformation of molybdenum. Similarly, a tensile stress of about 1600 MPa would be generated in alumina.

Both of the stress values are beyond the strengths of the corresponding materials, so that such composite structure cannot be produced because of the fracture along the interface of the brittle material and metal.

However, a stress generated in the metal beyond the yield strength of the metal results in the plastic deformation. The magnitude of the deformation until the fracture is represented by the elongation. Such elongation generally takes a considerably large value of several percent to several tens percent.

The thickness of the metal material is made relatively smaller than that of the ceramic material, so as to generate a stress larger than the yield strength of the metal to cause the plastic deformation, so that the overall stress generated due to the difference of the thermal expansion coefficients is relaxed.

For example, it is provided that the metal member is made of a thin plate of molybdenum having a thickness of 100 micrometer, and the ceramic block is made of alumina having a thickness of 10 mm, the strain in the molybdenum plate required for deforming the molybdenum plate and for relaxing the stress is represented by the following formula (3).

$$\epsilon = (T1 - \text{room temperature}) \times (\alpha 1 - \alpha 2) \sim 0.5\% \quad (3)$$

The amount of deformation in the direction of the thickness is represented by the formula.

$$\Delta t = \epsilon \times t \sim 0.5 \text{ micrometer} \quad (4)$$

It is thus possible to relax the overall stress by a considerably small amount of deformation.

The combination of platinum and alumina is taken for example, the thermal expansion coefficient and Young's modulus of platinum are about 9 ppm/K and about 170 GPa, respectively, and the thermal expansion coefficient and Young's modulus of alumina are about 8 ppm/K and about 360 GPa, respectively. For example, when alumina is sintered at 1500° C. and then cooled to room temperature, a tensile stress of about 250 MPa is generated in platinum member provided that no plastic deformation is generated in platinum. Similarly, a compressive stress of about 530 MPa is to be generated in the alumina member.

Also in this case, when the platinum member is made of a thin plate having a thickness of 100 mm and the alumina member is made of a block having a thickness of 10 mm, the strain in the platinum member required for deforming the platinum thin plate and for relaxing it is represented by the above formula (3) and about 0.1 percent in this case. Although a tensile stress is generated in the platinum member in the direction of the pressing and clamping, only 0.1 percent of deformation in the direction of the depth of the platinum plate can relax the tensile stress. The amount of deformation is only 10 μm, provided that the depth of the pressing and clamping is 10 mm.

As described above, the stress is generated mainly due to the difference of thermal expansion coefficients of the brittle and metal materials in the composite structure of the materials and thus reflects a strain of about 1 percent or lower. On the other hand, the yield strength of the metal material is lower than the tensile strength and the elongation required for the fracture is several percent to several tens percent. The thickness of the metal material is made relatively smaller than that of the brittle material so as to generate a stress larger than the yield strength of the metal to cause the plastic deformation for relaxing the difference of the thermal expansion coefficients. Even in this case, the amount of deformation is in a range of the elongation so that the fracture of the metal material is avoided. Further, the metal material is deformed to relax the stress generated in the brittle material to provide a composite structure of the brittle material and metal. When the materials are integrated utilizing sintering shrinkage requiring thermal process at a high temperature, the relaxing of the stress can be performed also due to deformation of the metal material such as high temperature creep.

According to a preferred embodiment, the difference of the thermal expansion coefficients of the brittle materials on the both side of the clamped part of the plate-shaped metal piece may preferably be 2 ppm/K or lower and more preferably be 1 ppm/K or lower. Most preferably, the thermal expansion coefficients are the same. The thermal expansion coefficients of the both brittle materials may be thus adjusted to further improve the stability and reliability of the structure of brittle material and metal against thermal cycles.

According to a preferred embodiment, the reflector substrate pressing the clamped part of the plate shaped metal piece is composed of a glass (glass ceramics), a dense sintered body of a ceramics or a cermet each having resistances against heat and thermal shock, and the inner supporting body is composed of the same material. Alternatively, the difference of thermal expansion coefficients of the inner supporting body and reflector substrate may preferably be 2 ppm/K or lower.

In this case, the plate shaped metal piece may be fixed between the reflector substrate and inner supporting body using a bonding material. Alternatively, the plate shaped metal piece is pre-fixed to the outside of the inner supporting body and then inserted into the reflector substrate heated at a predetermined temperature so that the substrate is expanded to fix them with each other by fitting by firing.

When the reflector substrate is molded with a process such as molten glass pressing with a glass or a glass ceramics, the plate shaped metal piece and inner supporting body may be fitted into a mold for press molding in advance. In this case, the plate shaped metal piece and inner supporting body can be integrated with the reflector substrate when the glass material for the reflector substrate is press molded in the mold. When the reflector substrate is densified by sintering of a molded body of powder, the sintering shrinkage of the reflector substrate can be utilized to integrate the plate shaped metal piece and inner supporting body. For example, the inner supporting body may be a sintered body having a sintering shrinkage different from that of the reflector substrate so that the plate shaped metal piece is pressed and clamped by the difference of thermal expansion coefficients of the reflector substrate and inner supporting body. A preferred range of the difference of thermal expansion coefficients will be described later.

Alternatively, according to a preferred embodiment, the inner supporting body may be made of a brittle material not subjected to sintering shrinkage such as a glass and a single crystal.

According to a preferred embodiment, the thickness of the plate-shaped metal piece may preferably be 1000 μm or smaller, and more preferably be 200 μm or smaller. The thickness of the plate-shaped metal piece may be made smaller as described above, to cause the deformation of the metal piece. It is thus possible to reduce the stress generated between the metal piece and brittle material due to the deformation of the plate shaped metal piece, facilitate the fixing of the discharge lamp having the luminous vessel and the reflector substrate to improve the resistance. If the plate-shaped metal piece is too thin, however, the strength as the structural body tends to be insufficient. On the viewpoint, the thickness of the metal piece may preferably be 20 μm or larger, and more preferably be 50 μm or larger.

When the plate shaped metal piece is fixed by the sintering of the reflector, the material of the plate shaped metal piece may preferably be a metal having a high melting point. Such metal may preferably be a pure metal selected from the group consisting of tungsten, molybdenum, rhenium, hafnium, niobium and tantalum, or the alloy of two or more metals selected from the group consisting of tungsten, molybdenum, rhenium, hafnium, niobium and tantalum. When the plate shaped metal piece is fixed with the bonding agent or fitting by firing, it is required that the material of the plate shaped metal piece has a resistance against heat and oxidation under the condition that an illuminating system using the reflector and discharge lamp is used. The materials include oxidation resistant iron-based alloys (stainless steel, nichrome, iron chrome etc.) and nickel.

Figure 5:
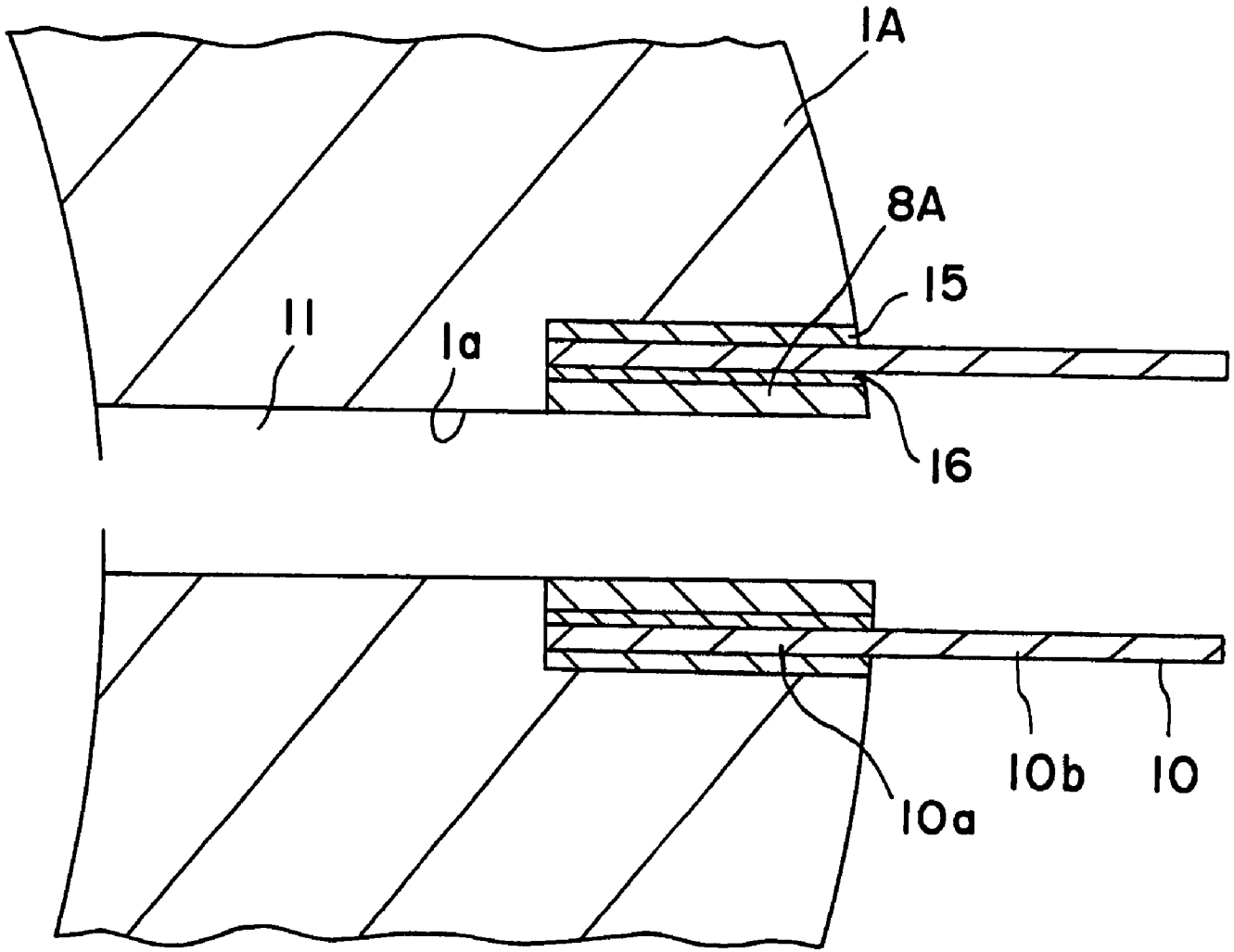
FIG. 5 is a cross sectional view showing an assembly of the fitting part shown in FIG. 4 before the production.

Specifically, as shown in FIG. 5, a reflector substrate 1A, an inner supporting body 8A and a plate shaped metal piece 1A are provided. A bonding material 15 is provided between the reflector substrate 1A and the plate shaped metal piece 10. A bonding material 16 is further provided between the inner supporting body 8A and plate shaped metal piece 10.

The material of the reflector substrate 1A may be, for example, a glass, a glass ceramics, a ceramics, a cermet or the like, each having resistances against heat and thermal shock. The material may be a molded body composed of powder, a dense sintered body or a structure of a glass. In the case of a molded body, the molded body may containing an organic binder or an additive such as a sintering aid. Further, the material may be the calcined body or dewaxed body obtained from the molded body.

The inner supporting body 8A is composed of, for example, ceramic powder or mixed powder for a cermet of ceramics and metal. The material may contain an organic binder or an additive such as a sintering aid. Further, the body 8A to be sintered may be a molded body composed of powder, the calcined body or the dewaxed body of the molded body. It is required, however, that the body 1A to be sintered has a sintering shrinkage larger than that of the body 8A to be sintered.

The material of the inner supporting body 8A may be selected from materials whose densification are completed and sintering shrinkage does not occur, including a ceramic sintered body, single crystal, glass, metal or the like. In this case, the difference of thermal expansion coefficients of the material of the inner supporting body 8A and the reflector substrate may preferably be 2 ppm/K or smaller.

When the molded body 1A of the reflector substrate and the molded body 8A of the inner supporting body are molded bodies, the molded bodies of the substrate and inner supporting body and the metal piece 10 are pre-fixed at predetermined positions, respectively, and then densified. As shown in FIG. 4 (after the sintering), the diameters of the reflector substrate 1 and inner supporting body 8 are reduced so that the substrate 1 and inner supporting body 8 are fixed as well as the metal piece 10.

During the sintering step, the outer diameter of the resulting sintered body of the body 8A of the inner supporting body is made larger than the inner diameter of sintered body of the body 1A of the reflector substrate, if each of the bodies would have been subjected to sintering alone. It is thus possible to apply a pressing force from the luminous vessel and the inner supporting body to the clamped portion 10*a* of the plate shaped metal piece 10 during the sintering, so as to improve the adhesion and air-tightness.

On the viewpoint, the ratio (RO/RI) may preferably be 1.04 or higher and more preferably be 1.05 or higher, provided that "RO" represents the outer diameter of the sintered body obtained by sintering the body 8A for the inner supporting body alone and "RI" represents the inner diameter of (through hole of) the sintered body obtained by sintering the body 1A for the reflector substrate.

If "RO/RI" is too larger, cracks tend to be generated in the inner supporting body or the reflector substrate. On the viewpoint, "RO/RI" may preferably be 1.20 or lower and more preferably be 1.15 or lower.

According to the embodiments of (1) and (2), the kind of each bonding agent is not particularly limited, and includes the followings.

(a) Ceramics selected from the group consisting of alumina, magnesia, yttria, lanthania and zirconia, or a mixture of a plurality of ceramic materials selected from the group consisting of alumina, magnesia, yttria, lanthania and zirconia.

(b) Cermet. The cermet may contain ceramics selected from the group consisting of alumina, magnesia, yttria, lanthania and zirconia, or the mixtures thereof.

The metal component of the cermet may preferably be a metal selected from the group consisting of tungsten, molybdenum and rhenium, or the alloy of two or more kinds of metals selected from the group consisting of tungsten, molybdenum and rhenium. It is thus possible to impart excellent corrosion resistance to the sealing member against a metal halide. In the cermet, the ratio of the ceramic component may preferably be 55 weight percent or more and more preferably be 60 weight percent or more (the balance is the metal component).

(c) A bonding material having a porous metal body (porous bone structure) and ceramic composition impregnated into the pores of the porous metal body.

EXAMPLES

Example 1

A structure of supporting a discharge lamp 3 with a reflector substrate was produced according to the procedure described referring to FIGS. 2, 4 and 5.

Specifically, the luminous vessel 5 was formed of quartz. The reflector substrate 1 was formed of alumina and the thickness was made about 4 mm. The power supply members 2A, 20 and 2B were composed of molybdenum round rods having diameter of 1 mm, respectively.

The inner diameter (after the sintering) of the through hole 1*a* was made 1.1 mm the plate shaped metal piece 10 was composed of a cylinder made of molybdenum and having a thickness of 100 to 200 μm. The inner supporting body 8 was molded with extrusion, pre-sintered and then processed to a predetermined dimension. The above described (RO/RI) was adjusted at 1.1. The sintering was performed at 1600° C. for 2 hours. At this stage, the reflector substrate 1 and inner supporting body 8 were sintered to fix the clamped part 10*a* of the plate shaped metal piece 10 between them. After the sintering, the surface of the reflector substrate was mechanically processed to adjust the shape and surface roughness to form a reflector film on the inner wall surface of the reflector substrate. The second power supply member 2B was inserted into the through hole 1*b* having a diameter of 1.1 mm, and then bonded with a heat resistant cement (trade name: SUMICERAM).

After the plate shaped metal piece 10 was fitted to the reflector substrate 1, the power supply member 2A was fixed using a fixing flange 9. The thickness of the fixing flange 9 was made 2 mm (preferably 1 to 3 mm). The heat resistant cement (trade name: SUMICERAM) was interposed between the fixing flange 9 and the plate shaped metal piece 10 to bond them, and the fixing flange 9 and the first power supply member 2A were also bonded with each other using the heat resistant cement (SUMICERAM). The discharge lamp was positioned and fixed while the lamp is subjected to active alignment with respect to the reflector substrate 1.

Argon gas was filled in the luminous vessel and cycles of turning on for three minutes and off for two minutes were repeated at a normal input power. As a result, the condensation of light at the condensed point was excellent to prove that the positioning was easy. Further, cracks were not observed in the luminous vessel after 2500 hours.

Example 2

The luminous vessel 5 was formed of quartz. The reflector substrate 1 was formed of silica-alumina-zinc series crystallized glass and the thickness was made about 4 mm. The silica-alumina-zinc series crystallized glass having a predetermined composition (main components: SiO2 55 weight percent: Al2O3, 20 weight percent: ZnO, 25 weight percent) was formulated, mixed and then molten at 1500° C. to obtain molten glass. The thus obtained molten glass was molded with press molding to a predetermined shape of a reflector. The through holes 1*a* and 1*b* and the hole 1*a* for inserting the inner supporting body 8 were processed and formed. The power supply members 2A, 20 and 2B were composed of stainless steel round rods having diameter of 1 mm, respectively.

The inner diameter of the through hole 1*b* was made 1.1 mm. The second power supply member 2B was inserted into the through hole 1*b* and then bonded with a pressing terminal. The diameter of the through hole 1*a* was made 1.1 mm. The plate shaped metal piece 10 was composed of a cylinder made of stainless steel having a thickness of 0.5 mm. The inner supporting body 8 was molded by pipe molding of molten glass of the silica-alumina-zinc series crystallized glass and then cut into a predetermined dimension. The plate shaped metal piece 10 and inner supporting body 8 were inserted into the hole for inserting inner supporting body of the reflector substrate 1. Heat resistant cement (trade name: SUMICERAM) was interposed between the plate shaped metal piece 10 and inner supporting body 8 to fix the clamped part 10*a* of the plate shaped metal piece 10.

The thus obtained assembly was heat treated so that the reflector substrate and inner supporting body were crystallized to obtain crystallized glass with fine crystals of β-quartz solid solution and Zn-petalite solid solution precipitated. A reflector film was formed on the inner wall face of the reflector substrate.

After the plate shaped metal piece 10 was fitted to the reflector substrate 1, the power supply member 2A was fixed using a fixing flange 9. The thickness of the fixing flange 9 was made 2 mm (preferably 1 to 3 mm). The heat resistant cement (trade name: SUMICERAM) was interposed between the fixing flange 9 and the plate shaped metal piece 10 to bond them and the fixing flange 9 and the first power supply member 2A were also bonded with each other using the heat resistant cement (SUMICERAM). The discharge lamp was positioned and fixed while the lamp is subjected to active alignment with respect to the reflector substrate 1.

The invention claimed is:

1. A structure for supporting a discharge lamp with a reflector substrate comprising a brittle material, said discharge lamp comprising a first electrode at a first longitudinal end thereof and a second electrode at a second longitudinal end thereof for discharge, and a luminous vessel, said structure comprising:

the reflector substrate;

a first power supply member electrically connected to said first electrode;

a second power supply member inclined at an angle with respect to the longitudinal axis of the discharge lamp;

a third power supply member electrically connected to said second electrode and to said second power supply member;

wherein a first through hole and a second through hole are formed in said reflector substrate, wherein said first power supply member is positioned and fixed in said first through hole, wherein said second power supply member is positioned and fixed in said second through hole, wherein said discharge lamp is supported with said reflector substrate through said first, second and third power supply members so that said discharge lamp is spaced from said reflector substrate, and wherein said first power supply member and said third power supply member are substantially aligned along a longitudinal axis of said discharge lamp.

2. The structure for supporting a discharge lamp of claim 1, further comprising a supporting member for supporting said first power supply member, wherein said supporting member comprises a clamped part clamped with said reflector substrate and a non-clamped part for supporting said first power supply member.

3. The structure for supporting a discharge lamp of claim 2, wherein said supporting member comprises a cylindrical metal piece, and wherein a stress generated along an interface where said clamped part and said brittle material contact each other is relaxed by plastic deformation of said cylindrical metal piece.

4. The structure for supporting a discharge lamp of claim 2, wherein said clamped part has a thickness of 20 to 1000 μm.

5. The structure for supporting a discharge lamp of claim 2, further comprising a bonding material provided between said clamped part and said brittle material.

6. The structure for supporting a discharge lamp of claim 3, wherein said cylindrical metal piece comprises first and second surfaces, wherein said cylindrical metal piece is supported with said reflector substrate at said first surface, and wherein said cylindrical metal piece is supported with an inner supporting body at said second surface.

7. The structure for supporting a discharge lamp of claim 6, wherein a difference of thermal expansion coefficients of said reflector substrate and said inner supporting body is 2 ppm/K or smaller.

8. The structure for supporting a discharge lamp of claim 1, wherein said brittle material forming said reflector substrate is selected from the group consisting of a glass and a glass ceramics.

9. The structure for supporting a discharge lamp of claim 3, wherein said cylindrical metal piece comprises an oxidation-resistant alloy of iron.

10. The structure for supporting a discharge lamp of claim 1, further comprising a reflector film formed on said reflector substrate.

11. An illumination system comprising the structure of claim 1, and a discharge lamp supported with said structure.

* * * * *